US006662534B2

(12) United States Patent
Straub et al.

(10) Patent No.: US 6,662,534 B2
(45) Date of Patent: Dec. 16, 2003

(54) APPARATUS FOR CHARGING TUBULAR CONTAINERS WITH A STACK OF FLAT ITEMS

(75) Inventors: Günter Straub, Schleitheim (CH); Peter Fritz, Eggingen (DE)

(73) Assignee: SIG Pack Systems AG, Beringen (CH)

( * ) Notice: Subject to any disclaimer, the term of this patent is extended or adjusted under 35 U.S.C. 154(b) by 243 days.

(21) Appl. No.: 09/819,697

(22) Filed: Mar. 29, 2001

(65) Prior Publication Data

US 2001/0025470 A1 Oct. 4, 2001

(30) Foreign Application Priority Data

Mar. 29, 2000 (CH) ..... 0608/00

(51) Int. Cl.[7] ..... B65B 35/50

(52) U.S. Cl. ..... 53/540; 53/243; 53/255; 53/541

(58) Field of Search ..... 53/540, 243, 255, 53/253, 258, 541

(56) References Cited

U.S. PATENT DOCUMENTS 3,267,636 A * 8/1966 Sternberg
3,812,647 A * 5/1974 Bertling et al.
4,052,838 A 10/1977 Hilton et al.
5,081,823 A * 1/1992 van der Ent ..... 53/540
5,353,576 A * 10/1994 Palamides et al. ..... 53/540
5,588,281 A * 12/1996 Boriani et al. ..... 53/540
6,050,060 A * 4/2000 Spatafora et al. ..... 53/541

* cited by examiner

*Primary Examiner*—Eugene Kim
*Assistant Examiner*—Sameh Tawfik
(74) *Attorney, Agent, or Firm*—Venable LLP; Robert Kinberg

(57) ABSTRACT

An apparatus for charging containers with a flat item stack, includes a supply conveyor; intermediate containers; and a transporting device carrying the intermediate containers into first and second stations. In the first station an item stack is loaded from the supply conveyor into the intermediate container, and in the second station an item stack is loaded from the intermediate container into a packaging container supported in the second station. A device rotates each intermediate container about an axis perpendicular to the advancing direction of the items on the supply conveyor from a first angular position into a second angular position and then back into the first angular position during travel of the intermediate container from the first station into the second station and back into the first station. A removing device in the second station carries away a filled packaging container.

9 Claims, 7 Drawing Sheets

APPARATUS FOR CHARGING TUBULAR CONTAINERS WITH A STACK OF FLAT ITEMS

CROSS REFERENCE TO RELATED APPLICATION

This application claims the priority of Swiss Application No. 2000 0608/00 filed Mar. 29, 2000, which is incorporated herein by reference.

BACKGROUND OF THE INVENTION

U.S. Pat. No. 4,052,838 describes an apparatus for packaging stacked, flat items (potato chips) into tubular packaging containers. In this apparatus a continuous flow of items is advanced to a downwardly inclined, pivotal trough. Item stacks are formed by means of two, alternatingly upward shifted separator lances arranged spaced from one another above the trough. The separated stacks slide into respective tubes which are arranged as wheel spokes and which are rotatable as a unit. As soon as a tube is filled, the tube assembly is incrementally rotated by one step about a horizontal axis. A tubular packaging container having a closed bottom is pulled over the filled tube in a subsequent station. As the tube assembly continues to rotate, the filled packaging container is deposited in a standing orientation on a removing conveyor belt.

Since the items are first deposited in a tube and then the container is inserted over the tube, the container has to have a greater diameter than necessary for receiving the items. It is a further disadvantage of such a prior art arrangement that when the item stack slides into the tube, the leading items of the stack are likely to tilt which may lead to operational disturbances because then only insufficient space is available in the tube for the entire stack. Also, for this reason, underweight packages may result which must be rejected as waste.

SUMMARY OF THE INVENTION

It is an object of the invention to provide an improved apparatus of the above-outlined type from which the discussed disadvantages are eliminated.

This object and others to become apparent as the specification progresses, are accomplished by the invention, according to which, briefly stated, the apparatus for charging containers with a flat item stack includes a supply conveyor; intermediate containers; and a transporting device carrying the intermediate containers into first and second stations. In the first station an item stack is loaded from the supply conveyor into the intermediate container, and in the second station an item stack is loaded from the intermediate container into a packaging container supported in the second station. A device rotates each intermediate container about an axis perpendicular to the advancing direction of the items on the supply conveyor from a first angular position into a second angular position and then back into the first angular position during travel of the intermediate container from the first station into the second station and back into the first station. A removing device in the second station carries away a filled packaging container.

DESCRIPTION OF THE PREFERRED EMBODIMENTS

Figure 1:
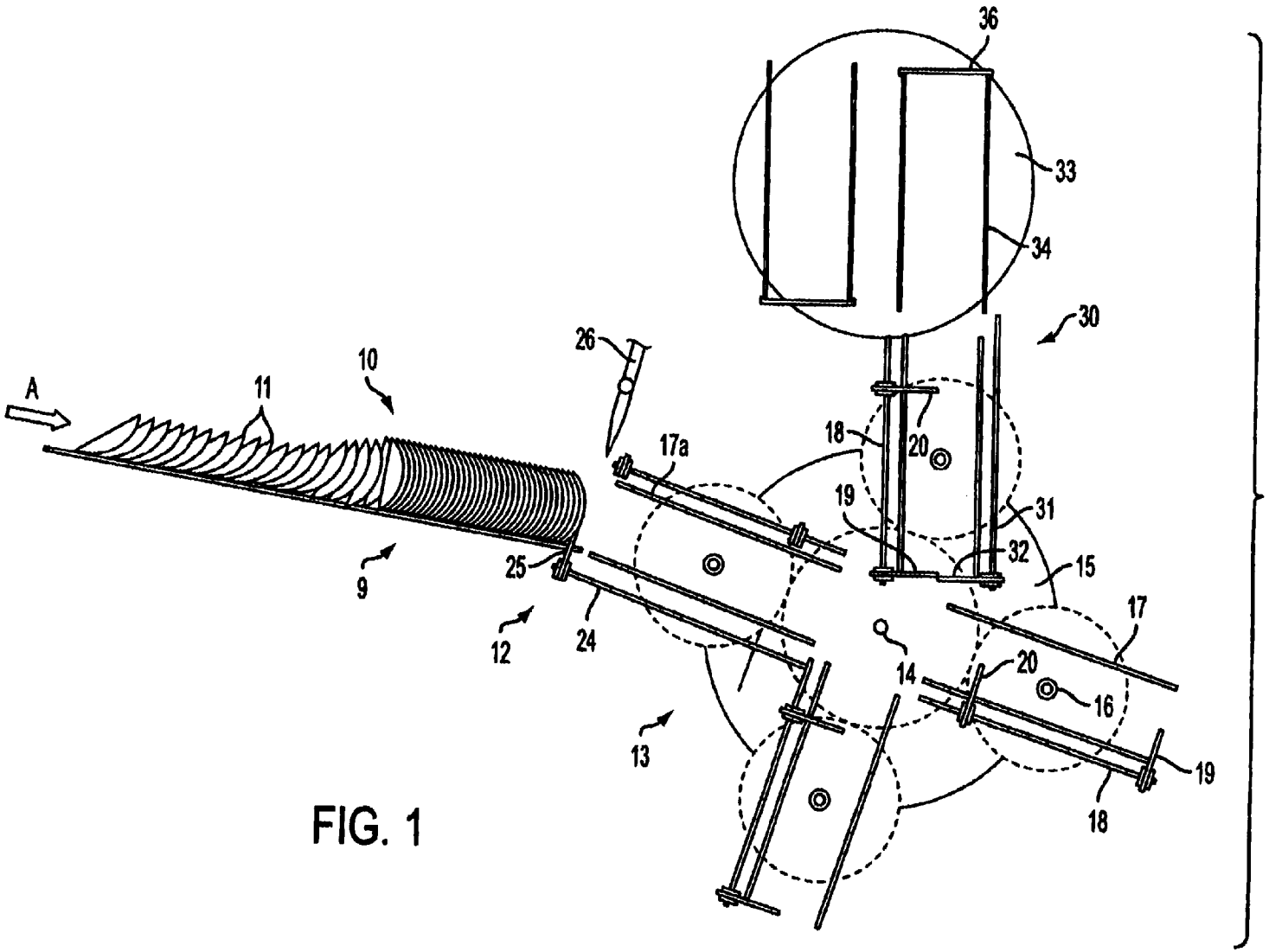
FIGS. 1–8 are schematic side elevational views of the apparatus according to a preferred embodiment of the invention, illustrating consecutive operational positions.

Turning to FIGS. 1–8, the apparatus illustrated therein includes a supply conveyor 9, for example, a pivotal trough, on which a string 10 of stack-like arranged flat items, particularly potato chips, are continuously advanced in a conveying direction A. At a first station 12 the items 11 are backed up so that they assume a stacked, edgewise standing orientation. The apparatus further includes an intermediate conveyor 13 constituted by a rotary disk or platform 15 rotatable about a horizontal axis 14 and carrying four circumferentially arranged rotary shafts 16 which are oriented parallel to the axis 14 and are uniformly spaced therefrom. Each shaft 16 is connected with an intermediate container 17, and each container 17 is associated with a holding element including a rotary shaft 18 rotatably supported on the respective intermediate container 17. Two holding fingers 19, 20 extend from each shaft 18. The finger 19 is fixedly connected with the shaft 18 at the outer end of the intermediate container 17. The finger 20 is longitudinally shiftable on the shaft 18 and may be immobilized to adapt the distance between the fingers 19, 20 to the length of the stack 27 to be formed.

Figure 13:
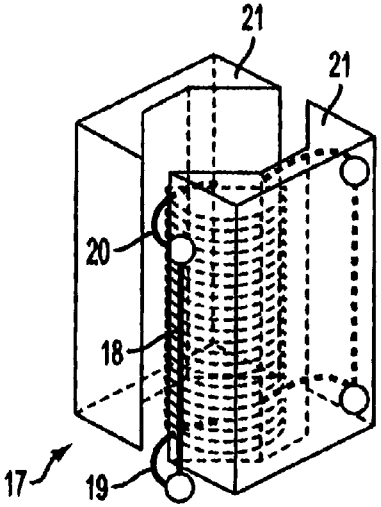
FIGS. 12 and 13 are schematic perspective views of an intermediate container shown in different operational phases.
Figure 12:
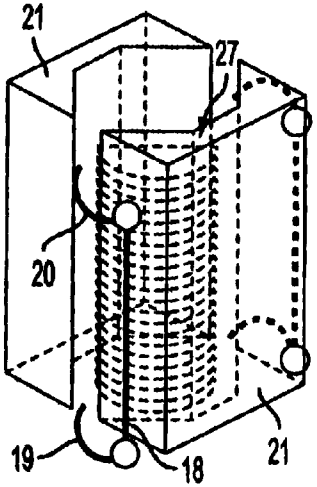

As may be observed in FIGS. 12 and 13, the intermediate containers 17 are each composed of two prismatic container parts 21 whose facing sides are concave and are spaced from one another. In the rotary position of the shaft 18 illustrated in FIG. 12 the ends of the fingers 19, 20 are situated externally of the intermediate container 17 whereas in the rotary position of the shaft 18 shown in FIG. 13 the ends of the fingers 19, 20 are positioned within the inner cross section of the intermediate container 17.

An inclined guide rail 24 is affixed to the machine frame in the first station 12. On the rail 24 a pick-up floor 25 is arranged for displacement by a non-illustrated motor from a fixed extended position shown in FIG. 1 into a settable base position illustrated in FIG. 4. A separator lance 26 oriented transversely to the conveying direction A and shiftable by means of a further, non-illustrated motor is arranged above the conveyor 10 at the downstream end thereof. Every time the pick-up floor 25 has performed its stroke from its extended position into its position in FIG. 3 the separator lance 26 is lowered and thus separates a stack 27 of potato chips within the intermediate container 17. Upon withdrawal of the pick-up floor 25 into the base position shown in FIG. 4, the respective shaft 18 is turned, so that its holding fingers 19, 20 arrive from their position shown in FIG. 12 into the position illustrated in FIG. 13 and thus straddle the stack 27. Thereafter the platform 15 is turned so that the filled intermediate container 17 arrives in the second station 30.

Figure 8:
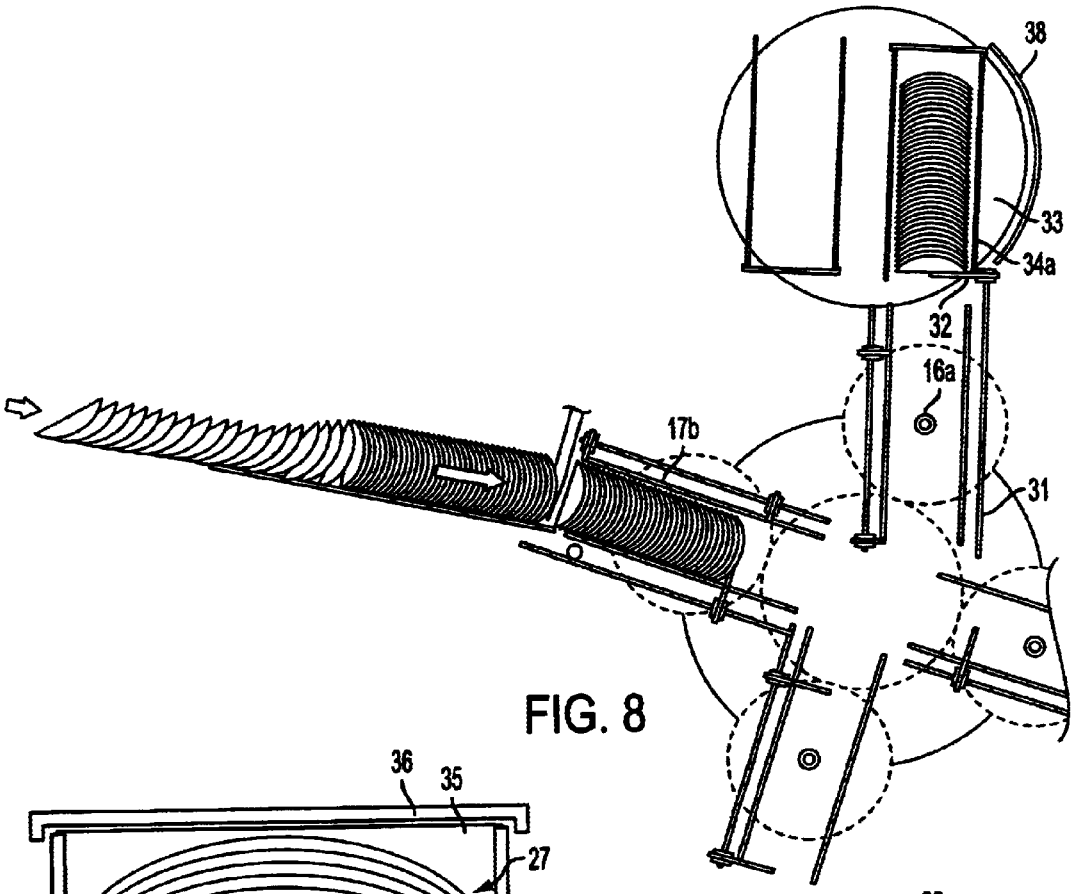

Simultaneously with the rotation of the platform 15 the filled intermediate container 17 is rotated by the shaft 16 such that when arriving in the second station 30 (carried by the platform 15), the non-shiftable (fixed) holding finger 19 is situated at the bottom. A guide rail 31 is fixedly attached to the machine frame in the second station 30. An ejector pusher 32 which is shiftable by means of a non-illustrated motor from its position shown in FIGS. 1 and 6 into the position illustrated in FIG. 8 is mounted on the rail 31. A rotary removing disk 33 is positioned in the second station 30 and carries two non-illustrated holding elements for the cylindrical container 34 to be filled. One end of the empty packaging containers 34 is closed by a sealing foil or film 35 (shown in FIG. 9) and a lid 36.

Figure 9:
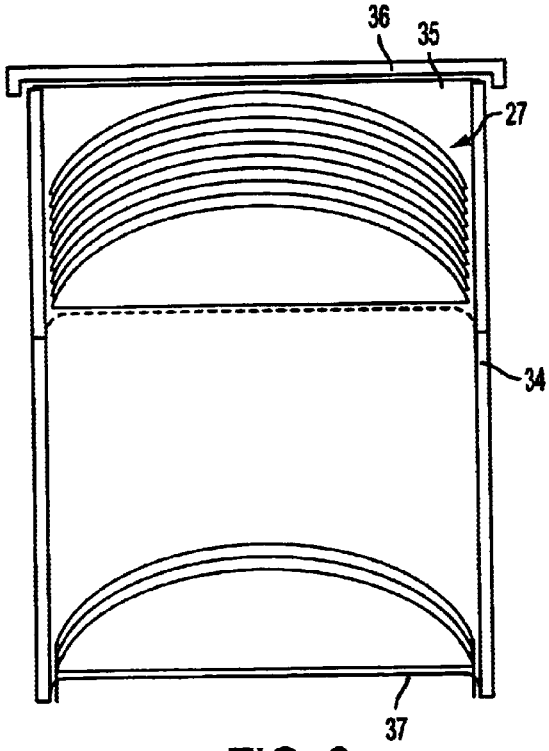
FIGS. 9 and 10 are sectional elevational views of filled containers.
Figure 10:
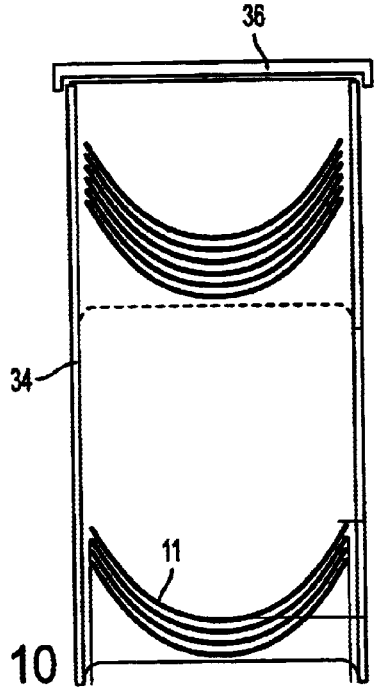

The rotary disk 33 is turned in 180° increments. In the second station 30 a packaging container 34 is positioned with its open end oriented downward and ready to receive an item stack 27 from an intermediate container 17. At the diametrically opposite side of the disk 33 a filled container 34 is exchanged for an empty container 34 by non-illustrated means, for example, a gripper. The filled container 34 is subsequently closed by a crimped-on bottom 37 (FIGS. 9 and 10).

FIGS. 1–8 schematically illustrate the sequential operation of the apparatus according to the invention. FIG. 1 shows the initial position in which the item string 10 is backed up on the extended pick-up floor 25, and the separating lance 26 is in its raised position. One of the intermediate containers 17*a* is situated in the first station 12 in alignment with the conveyor 9. The holding fingers 19, 20 of the intermediate container 17*a* are in the withdrawn position as shown in FIG. 12.

Figure 2:
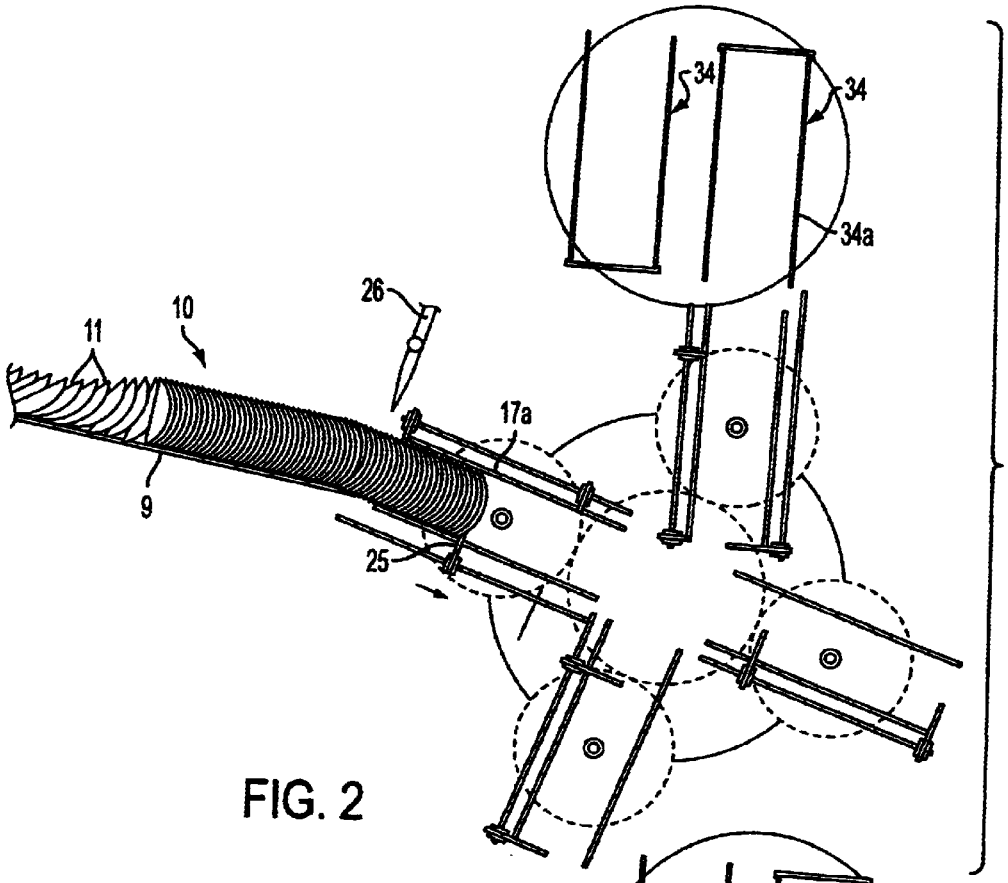
Figure 3:
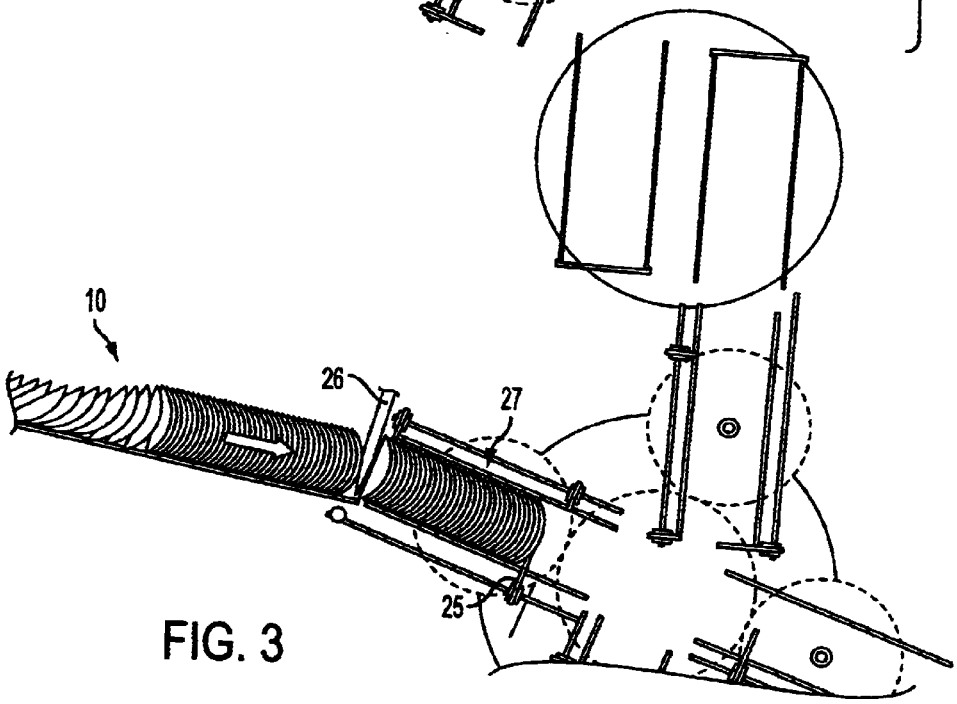
Figure 4:
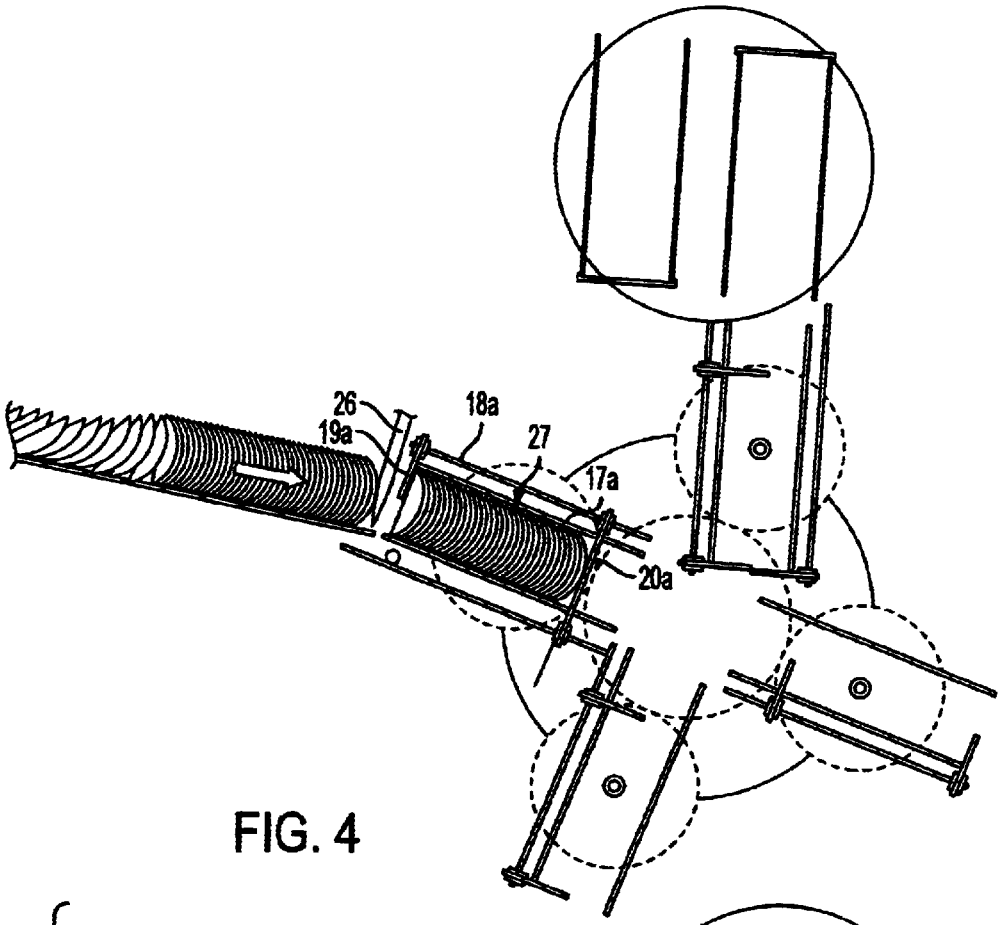

FIG. 2 shows the motion of the pick-up floor 25 while the items 11 are loaded into the intermediate container 17*a*. Before the pick-up floor 25 has reached its base position, the separating lance 26 is lowered and thus a stack 27 is divided from the string 10, as shown in FIG. 3. In the subsequent base position of the pick-up floor 25 according to FIG. 4 the stack 27 is fully inside the intermediate container 17*a*. The respective shaft 18*a* is rotated so that the fingers 19*a*, 20*a* extend into the container 17*a* and straddle the separated stack 27.

Figure 5:
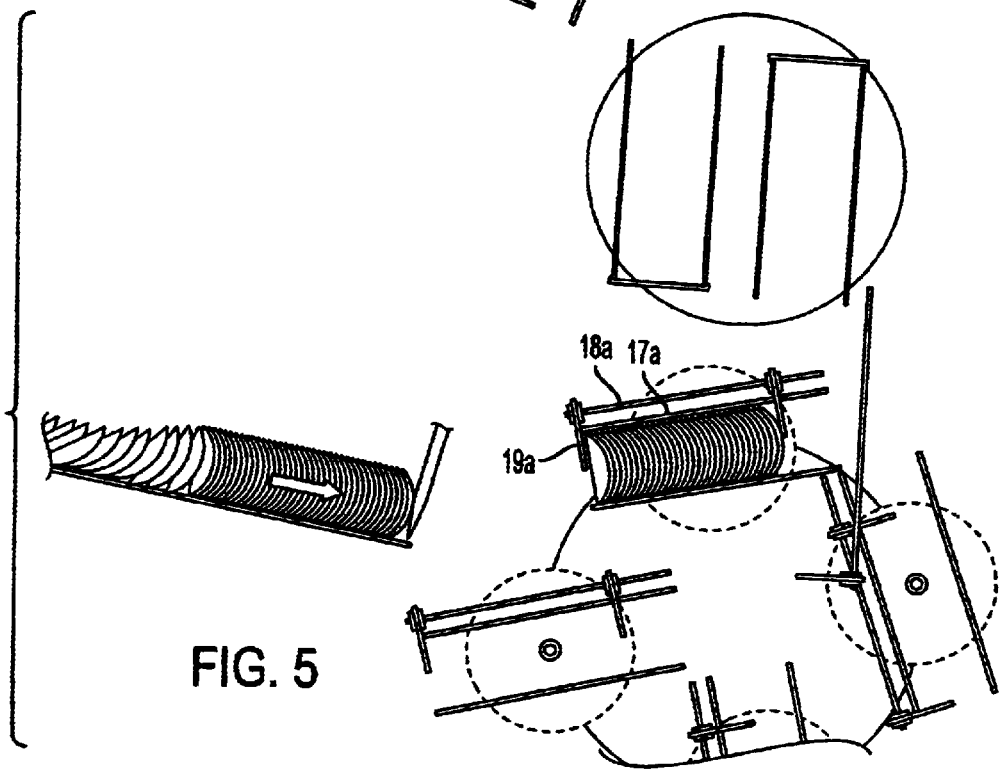
Figure 6:
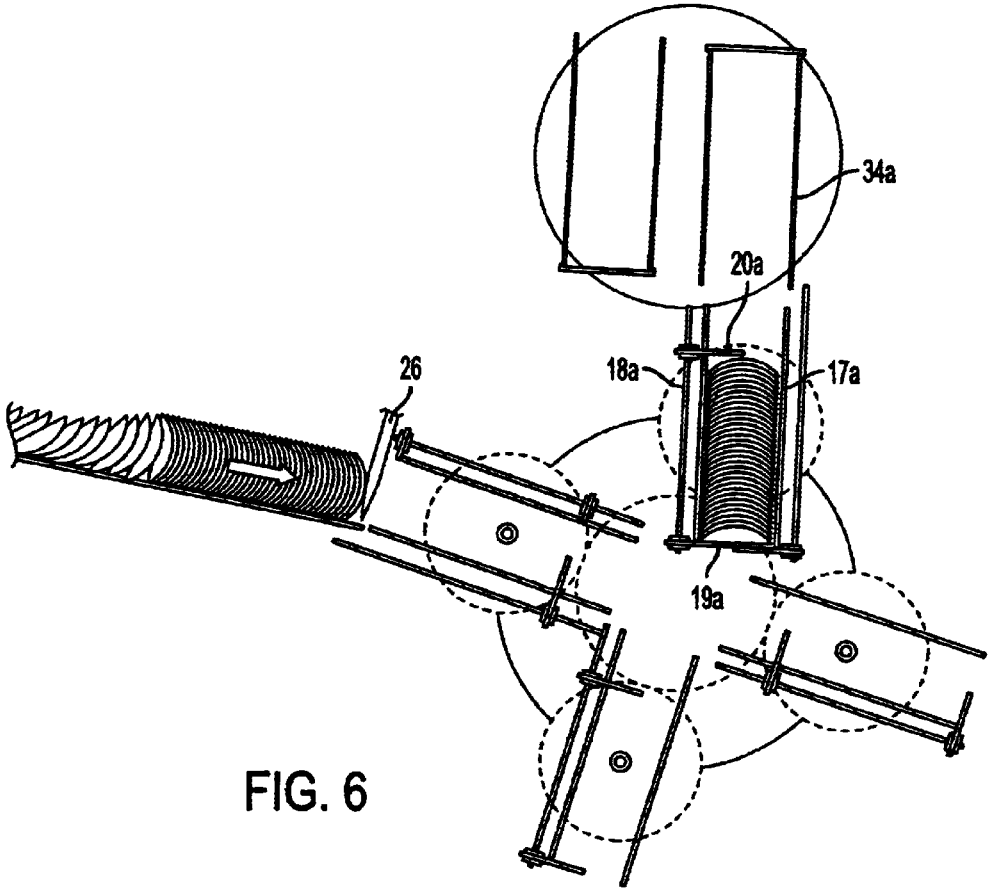
Figure 7:
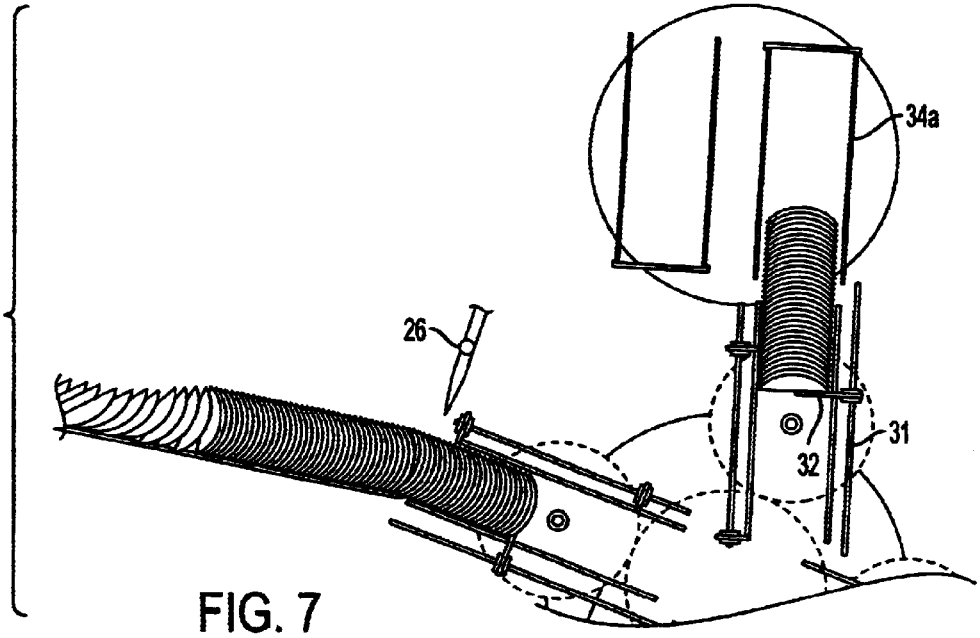

Thereafter the platform 15 is turned 90° clockwise and, at the same time, the respective shaft 16 is rotated counter-clockwise as shown in FIG. 5, until the position of FIG. 6 is attained and the intermediate container 17*a* is oriented vertically and the axially immovable holding finger 19*a* is positioned at the bottom. The intermediate container 17*a* is in axial alignment with the container 34*a* which is to be filled and which is situated above the intermediate container 17*a*.

As soon as the intermediate container 17*a* has reached a position above the ejector pusher 32, the shaft 18*a* is pivoted backward so that the fingers 19*a*, 20*a* are withdrawn from the region of the inner cross section of the intermediate container 17, and the ejector pusher 32 is raised (FIG. 7) until the entire stack 27 is pushed into the container 34*a* (FIG. 8). Thereafter, the disk 33 is rotated 180° and the filled container 34*a* is exchanged for an empty container at the diametrically opposite side of the disk 33. A guide plate 38 is provided as shown in FIG. 8 to ensure that the items do not drop out of the packaging container 34*a* during turning of the disk 33. During this phase the subsequent intermediate container 17*b* is filled in the earlier-described manner.

During subsequent further rotation of the platform 15, the shaft 16*a* of the intermediate container 17*a* is rotated either in the same or in the opposite direction until the intermediate container 17*a* again assumes its position relative to the platform 15 as shown in the first station 12 (FIG. 1). In contrast to the illustration in FIGS. 1–8, the fingers 19 and 20 remain in the outwardly pivoted position as the intermediate container 17 moves from the second station 30 into the first station 12.

Figure 11:
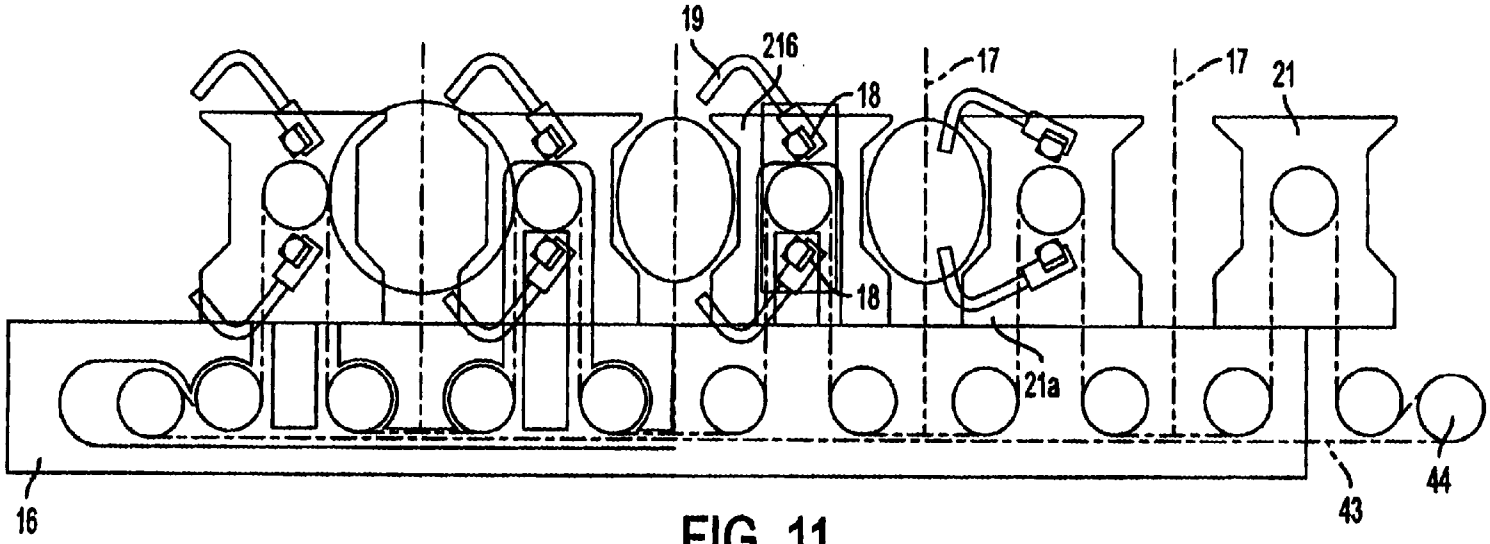
FIG. 11 is a schematic top plan view of a series of intermediate containers.
Figure 14:
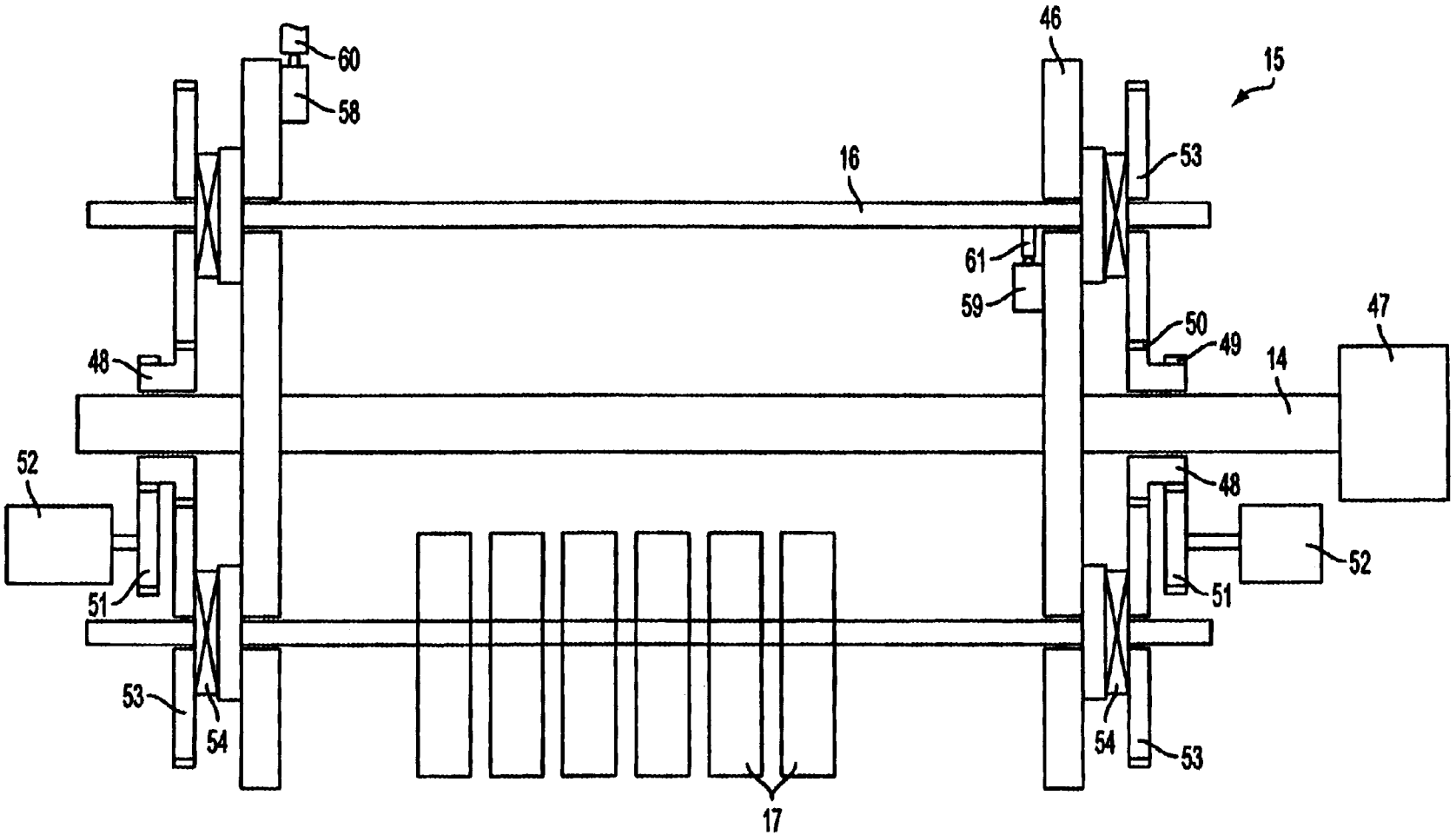
FIG. 14 is a schematic side elevational view of a variant of a component of the apparatus according to the invention.

As shown in FIGS. 11 and 14, several intermediate containers 17 may be positioned side-by-side on a common shaft 16. In such a case, an equal number of supply conveyors 19 are situated side-by-side and the removal conveyor 33 has a corresponding number of parallel receivers for the containers 34. The shafts 18 are mounted in pairs on the respective container part 21 and may be pivoted jointly, for example, by means of a toothed belt 43 and a motor 44 to move the fingers 19, 20 from an inward position shown at the part 21*a* in an outwardly-pivoted, withdrawn position shown at the other part 21*b*.

FIG. 14 schematically shows a variant of the rotary platform 15 described earlier. In the structure of FIG. 14 two disks 46 are provided which are rigidly connected to the shaft 14 driven by a motor 47. On the shaft 14, axially externally of the disks 46, a respective bushing 48 is supported, each carrying two annular gears 49, 50. Each gear 49 meshes with a respective gear 51 continuously driven by a motor 52. The two gears 51 rotate in opposite directions. The gears 50 mesh with four gears 53 rotatably supported on the four rotary shafts 16 (only two are visible in FIG. 14). The gears 53 may be coupled to the respective rotary shafts 16 by a respective, individually operable clutch-and-brake unit 54. Such clutch-and-brake units are known and are used, for example, in manual transmissions of motor vehicles. The units 54 are switchable into three positions: in a first position the rotary shaft 16 is coupled to the disks 46; in a second position the shaft 16 is coupled to the gear 53 and in a third or intermediate position the shaft 16 may rotate freely. The actuation of the units 54 may be effected, for example, by limit switches 58, 59 mounted on the disks 46. One limit switch 58 cooperates with a fixed cam 60 arranged immediately after the first station 12 and switches one unit 54 associated with a motor 52 into the second position and switches the second unit 54 of the same shaft 16 into the intermediate position. As soon as the shaft 16 has reached the desired angular position relative to the disks 46, a cam 61 connected with the shaft 16 actuates the other limit switch 59 thus switching the first unit 54 in first position. The reverse rotation of the shaft 16 upon leaving the second station 30 occurs in a similar manner.

It is, however, also feasible to rotate the intermediate container 17 by the shaft 16 always in the same sense relative to the platform 15. In such a variant one of the motors 52 as well as the associated parts 48, 53 and 54 are dispensed with and the remaining units 54 may be switched only in the first and second positions and cannot be switched into an intermediate position. Such a variant is of very simple construction.

The described apparatus has, in particular, the following advantages:

Cylindrical or saddle-shaped items such as potato chips may be in conveyed in a stable manner as an overlapping string 10 only in the position illustrated in FIGS. 1–8 in which their convex side is oriented opposite the conveying direction A. If such a string is directly filled into a packaging container 34, the convex side of the items 11 would be oriented towards the lid 36. Such a result would be disadvantageous for the consumer, because the items 11 could be grasped in the filled container 34 only with difficulty. By virtue of the rotary motion of the intermediate container 17 relative to the platform 15 as the container travels between the stations 12 and 30, such a disadvantage is eliminated according to the invention. The same advantage may be achieved by filling other, flat stacked products, for example, cookies having a chocolate cover layer on only one face which should be oriented in the container 34 towards the lid 36. It is to be understood that the same advantage could be achieved by filling the container 34 directly, but from the side of the lid 36. In such a case, however, significant difficulties arise concerning a securely sealed attachment of the foil 35. It would be practically unavoidable that at one part of the container 34 its upper end face becomes soiled by crumbs or grease which would make a hermetically tight sealing of the foil 35 impossible.

The same apparatus may also be used, without such a rotary motion, for packaging other, for example, non-curved items. In case such a possibility is to be reserved for the apparatus, the packaging container 34 which is standing by for being filled, would be arranged radially to the axis of the shaft 14, in contrast to the illustration in FIGS. 1–8. Such a mode of operation would have the advantage that the ejector pusher 32, dependent upon the stack height, would execute a shorter stroke and thus the cycling period would be shortened.

Thus, the apparatus according to the invention has a substantial versatility. It makes possible a gentle handling of the items 11, particularly during the rotary motions. Further, a secure filling of the containers is achieved because a tilting of the products 11 at one end of the stack 27 is securely prevented. A potential contamination of the sealed region by parts of the items is avoided. By virtue of the simultaneous occurrence of the rotary motion of the intermediate container while it travels from the first station to the second station and while it travels from the second station to the first station (reverse rotation) results in a high output.

It will be understood that the above description of the present invention is susceptible to various modifications, changes and adaptations, and the same are intended to be comprehended within the meaning and range of equivalents of the appended claims.

What is claimed is:

1. An apparatus for charging tubular packaging containers with a stack of flat items, comprising:

(a) a supply conveyor for advancing the items in an advancing direction;

(b) a plurality of intermediate containers;

(c) a transporting device carrying said intermediate containers and including means for moving said transporting device to consecutively advance said intermediate containers in a traveling path into a first station and a second station;

(d) first loading means for loading, in said first station, a stack of items from said supply conveyor into the intermediate container dwelling in said first station;

(e) means for positioning a packaging container in said second station for receiving the stack of items from said intermediate container dwelling in said second station;

(f) second loading means in said second station for loading, in said second station, the stack of items from said intermediate container into the packaging container;

(g) rotating means for rotating each said intermediate container about an axis perpendicular to said advancing direction from a first angular position in said first station into a second angular position in said second station during travel of the intermediate container from said first station into said second station and for rotating the intermediate container about said axis from said second angular position in said second station into said first angular position in said first station during travel of the intermediate container from said second station into said first station; and (h) removing means in said second station for carrying away a filled packaging container from said second station;

wherein said traveling path is circular and said rotating means includes a plurality of first shafts each connected with a respective said intermediate container; and further wherein said transporting device comprises:

(a) a platform rotatably supporting said first shafts;

(b) a second shaft affixed to said platform; and (c) a motor connected to said second shaft for rotating said platform.

2. The apparatus as defined in claim 1, further comprising:

(a) a second motor; and (b) a gearing coupling said second motor with respective said first shafts, said gearing having a gear mounted on said second shaft for rotation relative thereto.

3. The apparatus as defined in claim 2, further comprising clutch-and-brake units connected to said respective first shafts for selectively coupling said first shafts with said gear or said platform.

4. The apparatus as defined in claim 1, further comprising:

(a) two second motors;

(b) a gearing coupling said second motors with respective said first shafts, said gearing having two gears mounted on said second shaft for rotation relative thereto; and (c) individually switchable clutch-and-brake units connected to respective said first shafts for selectively coupling said gears to said respective first shafts.

5. The apparatus as defined in claim 1, wherein said first loading means comprises:

(a) a fixed guide extending at least approximately parallel to a longitudinal axis of said intermediate container dwelling in said first station;

(b) a pusher slidably mounted on said fixed guide for shifting a stack of items from said supply conveyor into the intermediate container dwelling in said first station; and (c) a separating lance mounted for movement transversely to said advancing direction to penetrate between two items on said supply conveyor.

6. An apparatus for charging tubular packaging containers with a stack of flat items, comprising:

(a) a supply conveyor for advancing the items in an advancing direction;

(b) a plurality of intermediate containers;

(c) a transporting device carrying said intermediate containers and including means for moving said transporting device to consecutively advance said intermediate containers in a traveling path into a first station and a second station;

(d) first loading means for loading, in said first station, a stack of items from said supply conveyor into the intermediate container dwelling in said first station;

(e) means for positioning a packaging container in said second station for receiving the stack of items from said intermediate container dwelling in said second station;

(f) second loading means in said second station for loading, in said second station, the stack of items from said intermediate container into the packaging container;

(g) rotating means for rotating each said intermediate container about an axis perpendicular to said advancing direction from a first angular position in said first station into a second angular position in said second station during travel of the intermediate container from said first station into said second station and for rotating the intermediate container about said axis from said second angular position in said second station into said first angular position in said first station during travel of the intermediate container from said second station into said first station; and (h) removing means in said second station for carrying away a filled packaging container from said second station;

wherein said second loading means comprises:

(a) a fixed guide extending at least approximately parallel to a longitudinal axis of said intermediate container dwelling in said second station; and (b) a pusher slidably mounted on said fixed guide for shifting the stack of items from said intermediate container, dwelling in said second station, into the packaging container held in said second station.

7. The apparatus as defined in claim 6, wherein each said intermediate container is composed of longitudinal partial containers extending parallel to one another and together defining a cavity.

8. An apparatus for charging tubular packaging containers with a stack of flat items, comprising:

(a) a supply conveyor for advancing the items in an advancing direction;

(b) a plurality of intermediate containers;

(c) a transporting device carrying said intermediate containers and including means for moving said transporting device to consecutively advance said intermediate containers in a traveling path into a first station and a second station;

(d) first loading means for loading, in said first station, a stack of items from said supply conveyor into the intermediate container dwelling in said first station;

(e) means for positioning a packaging container in said second station for receiving the stack of items from said intermediate container dwelling in said second station;

(f) second loading means in said second station for loading, in said second station, the stack of items from said intermediate container into the packaging container;

(g) rotating means for rotating each said intermediate container about an axis perpendicular to said advancing direction from a first angular position in said first station into a second angular position in said second station during travel of the intermediate container from said first station into said second station and for rotating the intermediate container about said axis from said second angular position in said second station into said first angular position in said first station during travel of the intermediate container from said second station into said first station;

(h) removing means in said second station for carrying away a filled packaging container from said second station;

(i) pairs of fingers mounted on said transporting device and cooperating with respective said intermediate containers, said fingers having a first position in which they extend into said respective intermediate containers for straddling the stack of items accommodated therein and a second position in which they are withdrawn from said intermediate containers; and (j) means for adjusting a distance between the fingers of each said pair.

9. The apparatus as defined in claim 8, further comprising means for pivotally supporting the fingers of said pairs on said respective intermediate containers.

* * * * *